US006185275B1

(12) United States Patent
Toth et al.

(10) Patent No.: US 6,185,275 B1
(45) Date of Patent: Feb. 6, 2001

(54) SYSTEMS AND METHODS FOR CORRECTING FOCAL SPOT THERMAL DRIFT

(75) Inventors: Thomas L. Toth, Brookfield; Eugene C. Williams, Waukesha, both of WI (US)

(73) Assignee: General Electric Company, Milwaukee, WI (US)

( * ) Notice: Under 35 U.S.C. 154(b), the term of this patent shall be extended for 0 days.

(21) Appl. No.: 09/140,111

(22) Filed: Aug. 25, 1998

(51) Int. Cl.[7] ..... H05G 1/52

(52) U.S. Cl. ..... 378/113; 378/113; 378/16; 378/19; 378/4; 378/207; 378/138; 378/137; 378/11; 378/12

(58) Field of Search ..... 378/113, 16, 19, 378/4, 207, 137, 138, 11, 12

(56) References Cited

U.S. PATENT DOCUMENTS 4,991,189 * 2/1991 Boomgaarden et al. ..... 378/4
5,706,326 * 1/1998 Gard ..... 378/19
6,056,437 * 5/2000 Toth ..... 378/205

* cited by examiner

*Primary Examiner*—Frank G. Font
*Assistant Examiner*—Delma R. Flores Ruiz
(74) *Attorney, Agent, or Firm*—Armstrong, Teasdale; Christian G. Cabou; Phyllis Y. Price

(57) ABSTRACT

The present invention, in one form, is a system for correcting thermal drift in an imaging system. More specifically, a correction algorithm determines an adjusted focal spot position based upon a first temperature focal spot position and a second temperature focal spot position. The adjusted focal spot position is utilized in the reconstruction process to correct for focal spot movement resulting from thermal drift.

29 Claims, 1 Drawing Sheet

SYSTEMS AND METHODS FOR CORRECTING FOCAL SPOT THERMAL DRIFT

BACKGROUND OF THE INVENTION

This invention relates generally to imaging systems and more particularly, to correcting x-ray source focal spot thermal drift in an imaging system.

In at least one known computed tomography (CT) imaging system configuration, an x-ray source projects a fan-shaped beam which is collimated to lie within an X-Y plane of a Cartesian coordinate system and generally referred to as the "imaging plane". The x-ray beam passes through the object being imaged, such as a patient. The beam, after being attenuated by the object, impinges upon an array of radiation detectors. The intensity of the attenuated beam radiation received at the detector array is dependent upon the attenuation of the x-ray beam by the object. Each detector element of the array produces a separate electrical signal that is a measurement of the beam attenuation at the detector location. The attenuation measurements from all the detectors are acquired separately to produce a transmission profile.

In known third generation CT systems, the x-ray source and the detector array are rotated with a gantry within the imaging plane and around the object to be imaged so that the angle at which the x-ray beam intersects the object constantly changes. A group of x-ray attenuation measurements, i.e., projection data, from the detector array at one gantry angle is referred to as a "view". A "scan" of the object comprises a set of views made at different gantry angles, or view angles, during one revolution of the x-ray source and detector. In an axial scan, the projection data is processed to construct an image that corresponds to a two dimensional slice taken through the object. One method for reconstructing an image from a set of projection data is referred to in the art as the filtered back projection technique. This process converts the attenuation measurements from a scan into integers called "CT numbers" or "Hounsfield units", which are used to control the brightness of a corresponding pixel on a cathode ray tube display.

The x-ray source typically includes an evacuated glass x-ray envelope containing an anode and a cathode. X-rays are produced by applying a high voltage across the anode and cathode and accelerating electrons from the cathode against a focal spot on the anode. The x-rays produced by the x-ray tube diverge from the focal spot in a generally conical pattern.

To produce a quality image from an axial scan in CT scanners such as, for example, a third-generation CT scanner, it is desirable for the focal spot to be properly aligned in the x-axis. At least one known CT imaging system aligns the x-ray source at a single temperature, for example, an ambient temperature. However, as various elements of the x-ray tube heat during use, thermal expansion causes small mechanical displacements of critical x-ray source structures and a corresponding shift in focal spot position. As a result of this thermal drift, the single temperature alignment does not accurately reflect the position of the x-ray source focal spot during a scan of an object. Such thermal drift of the x-ray source focal spot results in aliasing and reduced image quality.

It would be desirable to provide a correction algorithm which is effective in correcting for focal spot position thermal drift. It would also be desirable to provide such an algorithm which improves image quality without increasing the costs of the system.

BRIEF SUMMARY OF THE INVENTION

These and other objects may be attained by a correction algorithm which, in one embodiment, determines an adjusted focal spot position based on a first temperature focal spot position and a second temperature focal spot position. The adjusted focal spot position is then used during the reconstruction process to correct the projection data for the x-ray source thermal drift. Particularly and in accordance with one embodiment, a first temperature focal spot position is determined. After operating the imaging system for a determined period of time, a second temperature focal spot position is determined. Using the first temperature focal spot position and the second temperature focal spot position, the adjusted focal spot position is determined. More particularly and in one embodiment, the adjusted focal spot position is determined to be a midpoint of the first temperature focal spot position and the second temperature focal spot position.

After determining the adjusted focal spot. position, projection data collected from a detector array is corrected for x-ray source focal spot thermal drift. Specifically, after collecting the projection data, the adjusted focal spot position is used in the reconstruction process to correct for the thermal drift of the focal spot.

The above described algorithm corrects for focal spot position thermal drift so that aliasing is minimized and image quality is improved. Such algorithm also does not significantly increase the costs of the imaging system.

DETAILED DESCRIPTION OF THE INVENTION

Figure 1:
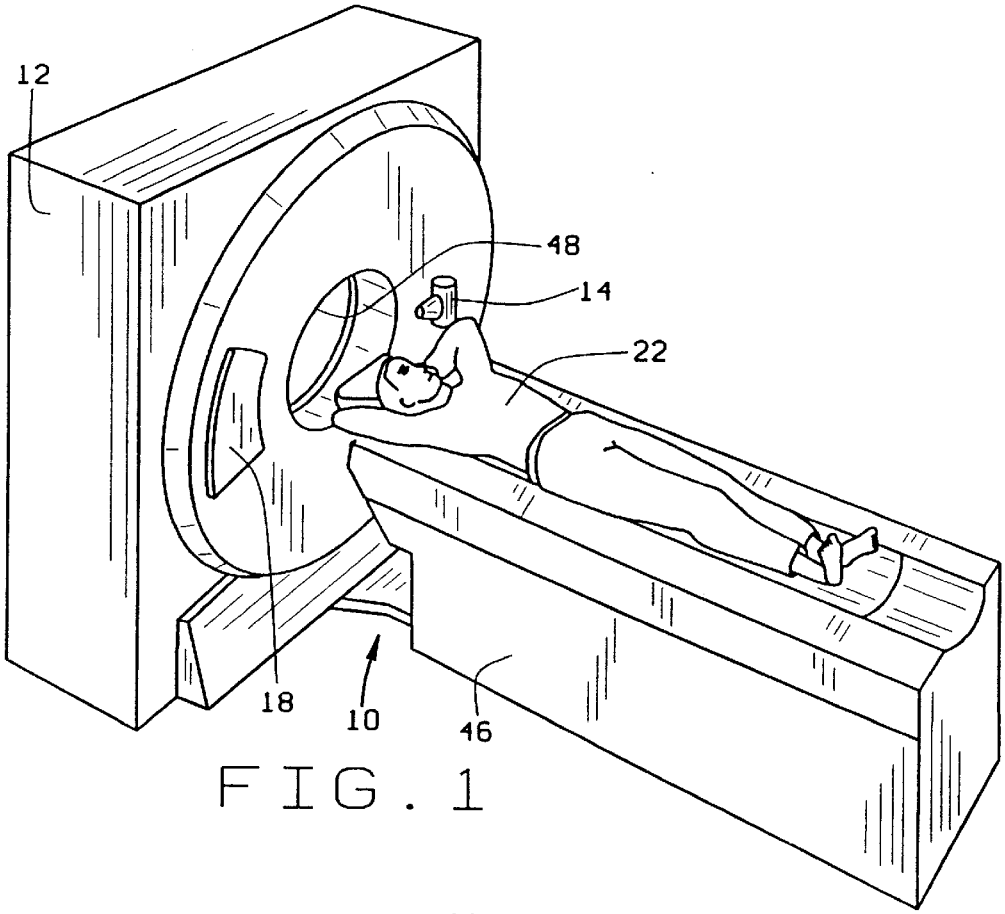
FIG. 1 is a pictorial view of a CT imaging system.
Figure 2:
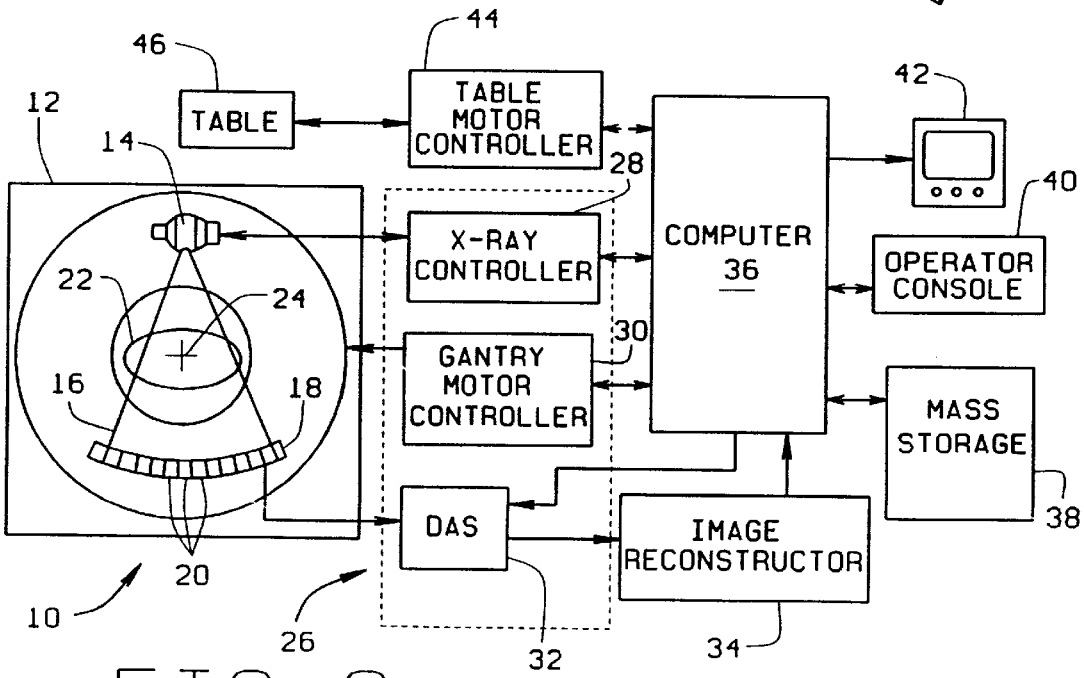
FIG. 2 is a block schematic diagram of the system illustrated in FIG. 1.

Referring to FIGS. 1 and 2, a computed tomograph (CT) imaging system 10 is shown as including a gantry 12 representative of a "third generation" CT scanner. Gantry 12 has an x-ray source 14 that projects a beam of x-rays 16 toward a detector array 18 on the opposite side of gantry 12. Detector array 18 is formed by detector elements 20 which together sense the projected x-rays that pass through a medical patient 22. Detector array 18 may be fabricated in a single slice or multi-slice configuration. Each detector element 20 produces an electrical signal that represents the intensity of an impinging x-ray beam and hence the attenuation of the beam as it passes through patient 22. During a scan to acquire x-ray projection data, gantry 12 and the components mounted thereon rotate about a center of rotation 24.

Rotation of gantry 12 and the operation of x-ray source 14 are governed by a control mechanism 26 of CT system 10. Control mechanism 26 includes an x-ray controller 28 that provides power and timing signals to x-ray source 14 and a gantry motor controller 30 that controls the rotational speed and position of gantry 12. A data acquisition system (DAS) 32 in control mechanism 26 samples analog data from detector elements 20 and converts the data to digital signals for subsequent processing. An image reconstructor 34 receives sampled and digitized x-ray data from DAS 32 and performs high speed image reconstruction. The reconstructed image is applied as an input to a computer 36 which stores the image in a mass storage device 38.

Computer 36 also receives commands and scanning parameters from an operator via console 40 that has a keyboard. An associated cathode ray tube display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 36 operates a table motor controller 44 which controls a motorized table 46 to position patient 22 in gantry 12. Particularly, table 46 moves portions of patient 22 through gantry opening 48. Additional details regarding the above described imaging system are set forth in co-pending U.S. patent application Ser. No. (15-CT-4641), entitled Scalable Multi-slice Imaging System, which is assigned the present assignee and hereby incorporated herein, in its entirety, by reference.

The correction algorithm described below may be implemented in computer 36 and practiced using data collected by DAS 32. It will be apparent to those skilled in the art, of course, that such algorithm could be practiced in other components. For example, the algorithm may be practiced directly in image reconstructor 34 so that corrected data is supplied to computer 36.

In accordance with one embodiment of the present invention, the position of an x-ray source x-axis focal spot is determined for at least two separate temperatures of system 10, specifically, x-ray source 14. Utilizing the determined focal spot positions, an adjusted focal spot position is determined.

Specifically, a focal spot position is determined and stored when system 10, specifically source 14, is at a cold, or ambient temperature, for example 70 degrees F. In one embodiment, the focal spot position is determined by scanning a metal pin (not shown) positioned near an iso-center (not shown) of system 10. More specifically, the metal pin is positioned approximately about 1.4" above and approximately about 1.4" right of the iso-center of system 10. Particularly, a ⅛" diameter round metal pin is properly positioned by attaching the pin to the end of gantry table 46 nearest gantry 12, or on a phantom holder (not shown). The pin is then scanned and the x-ray focal spot is determined. Specifically, utilizing attenuation data collected from detector array 18, the x-ray focal spot is determined. In alternative embodiments, other methods may be utilized to determine the position of the x-ray focal spot.

A number of scans are then performed by system 10 until source 14 achieves a second temperature, for example, approximately about a maximum operating temperature of source 14. A second temperature focal spot position is then determined and stored in a similar manner as described above. The second temperature focal spot position may be different than the first temperature focal spot position as a result of thermal drift of the focal spot.

Utilizing the first temperature focal spot position and the second temperature focal spot position, an adjusted focal spot position is determined. Specifically and in one embodiment, the adjusted focal spot position exists in a range between the first temperature focal spot position and second temperature focal spot position. For example, a position difference is determined between the first temperature focal spot position and the second temperature focal spot position. The adjusted focal spot position is then determined by adding a percentage of the position difference to the first temperature focal spot position so that the adjusted focal spot position is between the first temperature and second temperature focal spot positions.

For example, where a focal spot position at a first temperature, T1, is determined to be at location 373 and a focal spot position at a second temperature, T2, is determined to be at location 374, the position difference is (374−373)=1. As a result of thermal drift of the focal spot, the adjusted focal spot position may be determined to be within a range of 373 and 374. The adjusted focal spot position within the range is then determined. Specifically, where T1 is a room ambient temperature, T2 is a maximum operating temperature and as a result of source 14 typically operating at a temperature closer to the maximum operating temperature than an ambient temperature, the adjusted focal spot position may be selected to be closer to the T2 focal spot position. More specifically, the typical operating temperature of x-ray source 14 may be 70% of the maximum operating temperature. As a result, the adjusted focal spot position may include 70% of the position difference. Particularly, the adjusted focal spot position may be ((70%×(374−373))+373)=373.7.

Of course, other factors may be considered in determining the adjusted focal spot position in system 10. For example, the adjusted focal spot position may be determined to be at a midpoint between the first temperature focal spot position and the second temperature focal spot position. Additionally, the adjusted focal spot position within the range may be altered as a result of the type of test being conducted. For example, in some known clinical environments, x-ray source 14 is operated at 50% to 75% of the maximum operating temperature. By properly determining the adjusted focal spot position within the position difference, the actual focal spot position and the adjusted focal spot position used in the reconstruction process will be very close. As a result, image quality will be optimized without significantly increasing the system costs and without requiring additional processing time to determine focal spot position during a scan.

The adjusted focal spot position is then used during the reconstruction process to generate the image data. Specifically, the adjusted focal spot position may be used in known reconstruction algorithms to correct the data collected from detector array 18. More specifically and in one embodiment, to minimize aliasing of high contrast high resolution objects, the adjusted focal spot position may be used to correct a backprojector isocenter in the reconstruction process. The isocenter is corrected for thermal drift of focal spot 60. In other embodiments, the adjusted focal spot position may be used in other portions of the reconstruction process so that the data gathered during the scan is corrected for thermal drift of the focal spot.

The above described algorithm facilitates reducing aliasing of objects as a result of focal spot thermal drift. As a result, reconstructed image quality is improved. In addition, such improved quality is without significantly increasing the system cost and without additional processing time to determine focal spot position during a scan.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. For example, the imaging system described herein is a CT system. Many other imaging systems may be used, for example, x-ray imaging. In addition, the CT system described herein is a "third generation" system in which both the x-ray source and detector rotate with the gantry. Many other CT systems including "fourth generation". systems wherein the detector is a full-ring stationary detector and only the x-ray source rotates with the gantry, may be used if individual detector elements are corrected to provide substantially uniform responses to a given x-ray beam. Moreover, the system described herein performs an axial scan, however, the invention may be used with a helical scan although more than 360° of data are required. Accordingly, the spirit and scope of the invention are to be limited only by the terms of the appended claims.

What is claimed is:

1. A method for correcting x-ray source focal spot thermal drift in an imaging system, the imaging system including an x-ray source and a detector array having a plurality of detector cells, said method comprising the steps of:

determining a focal spot position of the x-ray source at temperature T1;

determining a focal spot position of the x-ray source at temperature T2; and determining an adjusted focal spot position based on the determined focal spot position of the x-ray source at temperature T1 and the determined focal spot position of the x-ray source at temperature T2.

2. A method in accordance with claim 1 further comprising the step of correcting projection data gathered from the detector array based on the adjusted focal spot position.

3. A method in accordance with claim 1 wherein determining a focal spot position at temperature T2 comprises the step of operating the imaging system so that the x-ray source temperature is approximately about temperature T2.

4. A method in accordance with claim 1 wherein determining a focal spot position at temperature T2 comprises the step of operating the x-ray source at approximately about a maximum operating temperature.

5. A method in accordance with claim 1 wherein determining a focal spot position at temperature T1 comprises the step of operating the x-ray source at approximately about an ambient room temperature.

6. A method in accordance with claim 1 wherein determining an adjusted focal spot position comprises the step of determining an adjusted focal spot position between the determined focal spot position at temperature T1 and the determined focal spot position at temperature T2.

7. A method in accordance with claim 1 wherein determining an adjusted focal spot position comprises the step of determining an adjusted focal spot position at approximately about a midpoint between the determined focal spot position at temperature T1 and the determined focal spot position at temperature T2.

8. A thermal drift correction system for an imaging system, the imaging system including an x-ray source producing an x-ray beam and a detector array having a plurality of detector cells, said correction system configured to be coupled to the detector array and to:

determine a focal spot position of the x-ray source at temperature T1;

determine a focal spot position of the x-ray source at temperature T2; and determine an adjusted focal spot position based on the determined focal spot position of the x-ray source at temperature T1 and the determined focal spot position of the x-ray source at temperature T2.

9. A correction system in accordance with claim 8 further configured to correct projection data gathered from the detector array based on the adjusted focal spot position.

10. A correction system in accordance with claim 8 wherein to determine a T2 focal spot position, said correction system is configured to operate the imaging system so that the x-ray source is approximately about temperature T2.

11. A correction system in accordance with claim 8 wherein to determine a focal spot position at temperature T2, said correction system configured to operate the x-ray source at approximately about a maximum operating temperature.

12. A correction system in accordance with claim 8 wherein to determine a focal spot position at temperature T1, said correction system is configured to operate the x-ray source at approximately about an ambient room temperature.

13. A correction system in accordance with claim 8 wherein to determine said adjusted focal spot position, said correction system is configured to determine an adjusted focal spot position between said determined focal spot position at temperature T1 and said determined focal spot position at temperature T2.

14. A correction system in accordance with claim 13 wherein said adjusted focal spot position between said determined focal spot position at temperature T1 and said determined focal spot position at temperature T2 is a midpoint between said determined focal spot position at temperature T1 and said determined focal spot position at temperature T2.

15. A correction system in accordance with claim 8 wherein the imaging system is configured to perform an axial scan.

16. A correction system in accordance with claim 8 wherein the imaging system is configured to perform a helical scan.

17. An imaging system comprising an x-ray source having a focal spot, a detector array, and a thermal drift correction system coupled to said detector array, said imaging system configured to:

determine said focal spot position of said x-ray source at temperature T1;

determine said focal spot position of said x-ray source at temperature T2; and determine an adjusted focal spot position based on said focal spot position of said x-ray source at temperature T1 and said focal spot position of said x-ray source at temperature T2.

18. An imaging system in accordance with claim 17 further configured to correct projection data gathered from said detector array based on said adjusted focal spot position.

19. An imaging system in accordance with claim 17 wherein to determine said focal spot position at temperature T2, said imaging system is configured to operate said x-ray source at approximately about temperature T2.

20. An imaging system in accordance with claim 17 wherein to determine said focal spot position at temperature T2, said imaging system configured to operate said x-ray source at approximately about a maximum operating temperature.

21. An imaging system in accordance with claim 17 wherein to determine said focal spot position at temperature T1, said imaging system configured to operate said x-ray source at approximately about an ambient room temperature.

22. An imaging system in accordance with claim 17 wherein to determine said adjusted focal spot position, said imaging system configured to determine an adjusted focal spot position between said determined focal spot position at temperature T1 and said determined focal spot position at temperature T2.

23. An imaging system in accordance with claim 22 wherein to determine said adjusted focal spot position, said imaging configured to determine a midpoint between said focal spot position at temperature T1 and said focal spot position at temperature T2.

24. An imaging system in accordance with claim 17 configured to perform an axial scan.

25. An imaging system in accordance with claim 17 configured to perform a helical scan.

26. An imaging system comprising a detector array, an x-ray source having a focal spot and configured to project an x-ray beam toward said detector array, and a computer coupled to said detector array for processing data collected by said detector array, said computer programmed to:

determine said focal spot position of said x-ray source at temperature T1;

determine said focal spot position of said x-ray source at temperature T2; and determine an adjusted focal spot position based on said focal spot position of said x-ray source at temperature T1 and said focal spot position of said x-ray source at temperature T2.

27. An imaging system in accordance with claim 26 wherein said processor further programmed to correct projection data gathered from said detector array based on said adjusted focal spot position.

28. An imaging system in accordance with claim 26 wherein to determine said adjusted focal spot position, said processor programmed to determine an adjusted focal spot position between said determined focal spot position at temperature T1 and said determined focal spot position at temperature T2.

29. An imaging system in accordance with claim 26 wherein to determine said adjusted focal spot position, said processor programmed to determine a midpoint between said determined focal spot position at temperature T1 and said determined focal spot position at temperature T2.

* * * * *